US005673821A

United States Patent [19]

Davis et al.

[11] Patent Number: 5,673,821

[45] Date of Patent: Oct. 7, 1997

[54] DISPENSING DEVICE FOR TWO FLUID MATERIALS

[75] Inventors: Adrian Francis Davis, Weybridge, England; Willy Lorscheidt, Cologne, Germany; David Reed Wilkins, Brentford, England

[73] Assignee: SmithKline Beecham PLC, England

[21] Appl. No.: 438,222

[22] Filed: May 9, 1995

Related U.S. Application Data

[63] Continuation of Ser. No. 39,001, filed as PCT/GB92/01542, Aug. 21, 1992, published as WO93/04940, Mar. 18, 1993, abandoned.

[30] Foreign Application Priority Data

Aug. 31, 1991 [GB] United Kingdom ..... 9118711

[51] Int. Cl.[6] ..... B67D 5/42

[52] U.S. Cl. ..... 222/137; 222/256

[58] Field of Search ..... 222/135, 137, 222/255, 256, 260, 321.1, 321.6, 321.7

[56] References Cited

U.S. PATENT DOCUMENTS

| | | | |
|---|---|---|---|
| 3,760,986 | 9/1973 | Castner et al. | 222/255 |
| 4,402,431 | 9/1983 | Wiegner et al | 222/260 |
| 4,437,584 | 3/1984 | Connors et al. | 222/137 |
| 4,438,871 | 3/1984 | Eckert | 222/137 |
| 4,903,868 | 2/1990 | Ichihara et al. | 222/256 |
| 4,949,874 | 8/1990 | Fiedler et al. | 222/135 |
| 5,104,004 | 4/1992 | von Schuckmann | 222/135 |
| 5,197,637 | 3/1993 | Naumann | 222/260 |

FOREIGN PATENT DOCUMENTS

| | | | |
|---|---|---|---|
| 0 202 359 | 11/1986 | European Pat. Off. . | |
| 2 305 967 | 8/1973 | Germany | 222/137 |
| 1597569 | 10/1990 | Russian Federation | 222/137 |

*Primary Examiner*—Andres Kashnikow
*Assistant Examiner*—Kenneth Bomberg
*Attorney, Agent, or Firm*—Nora Stein-Fernandez; Janice E. Williams; Edward T. Lentz

[57] ABSTRACT

A dispenser is provided for the concurrent dispensing of two different fluid materials. The dispenser has a first and second supply chamber for containing the two separate fluids, and a headpiece having a first pump chamber and pump piston connected to the first supply chamber and a first discharge channel, and a second pump chamber and pump piston connected to the second supply chamber and a second discharge channel. The first and second supply chambers have a coaxial arrangement.

7 Claims, 2 Drawing Sheets

DISPENSING DEVICE FOR TWO FLUID MATERIALS

This application is a continuation application of Ser. No. 08/039,001, filed May 19, 1994, now abandoned which is a 371 application of PCT/GB92/01542, filed Aug. 21, 1992 published as WO93/04940, Mar. 18, 1993.

DISPENSING DEVICE FOR TWO FLUID MATERIALS

This invention relates to a novel device, being a dispenser for dispensing together two fluid materials, more particularly comprising material supply chambers for containing the two materials and a head piece comprising pump and discharge mechanisms for the two materials.

BACKGROUND OF THE INVENTION

Dispensers of this type are known as portable supply containers in many fields of application and are used for dispensing liquid or paste-like products, e.g. for body care purposes, in the medical field for the application of medical compositions, or for the supply of paste-like alimentary products.

It is sometimes desired to disperse two viscous components simultaneously together, for example striped toothpaste formulations. A commonly adopted solution to this problem is a pump dispenser which contains both components in a single chamber, in direct physical contact with no intervening partition, relying upon the slowness of interdiffision to avoid mixing. Such a dispenser is clearly of no use when a chemical reaction can occur between the two components, in particular if such a reaction is actually intended to occur after the two components have been dispensed and subsequently mixed.

Attempts have been made to overcome the problems of premature mixing of reactive components in dispensers by dispensers which have two sets of containment chambers, pumps etc for the components, mounted side by side in a "double barrelled" arrangement. This system is inelegant and needs elaborate dispensing channels for the components unless they are to be dispensed in a side by side flow stream.

A further problem with components which are intended to react together after dispensing is that as the pumping pressure is released and the pump mechanism is allowed to return to a relaxed position small quantities of the dispensed components can be sucked back and mixed in the dispensing channels, where they can react. This can lead to contamination when components are subsequently dispensed, even clogging of the dispensing channels.

Dispensers are known e.g. in DE-A-3601311 which are equipped with a manually operable pump-piston delivery mechanism in conjunction with a product container which is separated from the head piece by a partition provided with a non-return valve and in which a follower piston acted upon by atmospheric pressure ensures the delivery of material from the product container to one pump delivery means of the head piece for dispensing the material through a discharge channel. The pump piston slides here in a pump chamber which, in turn, is connected to the discharge channel including a second non-return valve.

Such a dispenser is however of no use when a product is to be dispensed that consists of several components which are not to be premixed in the material supply chamber of the product container.

A dispenser for dispensing paste-like compounds is also known from DE-A-3737832 having in its head piece a separate product chamber for the combined dispensation of a two-component strand, this product chamber being in free communication with a pump chamber of the delivery means and with an inner container chamber. When the main product is dispensed, a vacuum is produced in the area of an outlet opening of the separate product chamber, whereby the main product can be provided with the additional material inside the discharge channel.

Such a dispenser is again not suited for the dispensation of different materials, such as a medical agent and its solvent, which are not to be mixed inside the dispenser.

A dispenser is known from U.S. Pat. No. 4,438,871 which has two separate coaxial chambers for containing two separate materials to be dispensed by a pump arrangement located in a dispensing head. However the dispensing head arrangement of this device is of complex and bulky construction, with tortuous dispensing pathways for these products, possibly leading to wastage.

A dispenser is also known from U.S. Pat. No. 4,949,874 and EP 0318834 which has two separate coaxial chambers for containing two separate materials to be dispensed by a pump arrangement, but in this dispenser the pumps are arranged side by side rather than concentric.

Particular problems of delivery are encountered when the two fluid materials comprise the first and second liquid phases (as defined therein) of a pharmaceutical composition of the type disclosed in EP-0152953A for topical application. In such compositions the first phase contains a dissolved drug and is preferably saturated with the drug, whilst the second phase is a chemically or physically different liquid from that in the first phase and contains no drug, but is miscible with the first phase. The two phases are selected so that on mixing in a predetermined ratio the resultant drug concentration exceeds the saturated drug solubility in the resultant mixture. This produces a miscible liquid mixture supersaturated in the drug, which can increase the rate of drug penetration into the skin.

It will be appreciated that supersaturated solutions as formed in the compositions of EP-0152953A have a limited stability and that it is consequently desirable that they are formed on the point of application to the skin. Hence any premixing of the phases is undesirable.

A further problem with the compositions of EP-015953 is that they tend to be jelly-like materials, the viscosity of each component of which can vary independently as a result of manufacturing variations and ambient storage temperatures. In the case of pharmaceutical formulations prescribed or sold over the counter the temperature difference between home storage in a cold room or near a radiator or in sunlight can significantly alter the viscosity. Such viscosity changes can have a drastic effect on the flow of such components in a dispenser. Moreover if it is intended that the pumping action of a dispenser is to be hand action, there can be significant variation in the amount and rate of pressure application between consumers. It is therefore highly desirable to provide a dispenser which can dispense such formulations with an acceptably repeatable flow rate independent of component viscosity and pump pressure.

It is therefore an object of the present invention to provide a dispenser of the above-mentioned type which serves to dispense fluid materials, in particular liquid or paste-like materials, and permits a reliable, controlled dispensing of different phases of material such that the ratio of the two phases is kept at the same predetermined value independent of the total volume dispersed, without any premixing inside the dispenser.

SUMMARY OF THE INVENTION

According to this invention, a dispenser for dispensing together a first fluid material and a second fluid material comprises a first material supply chamber and a second material supply chamber for respectively containing first and second fluid materials, and a head piece which comprises a first pump chamber having a first pump piston and being connectable to a first discharge channel and to the first material supply chamber, and a second pump chamber having a second pump piston and being connectable to a second discharge channel and to the second material supply chamber, and having a coaxial arrangement of at least the first and second discharge channels, optionally also the first and second pump chambers and optionally also the first and second material supply chambers being in a coaxial arrangement.

DESCRIPTION OF THE PREFERRED EMBODIMENTS

Figure 1:
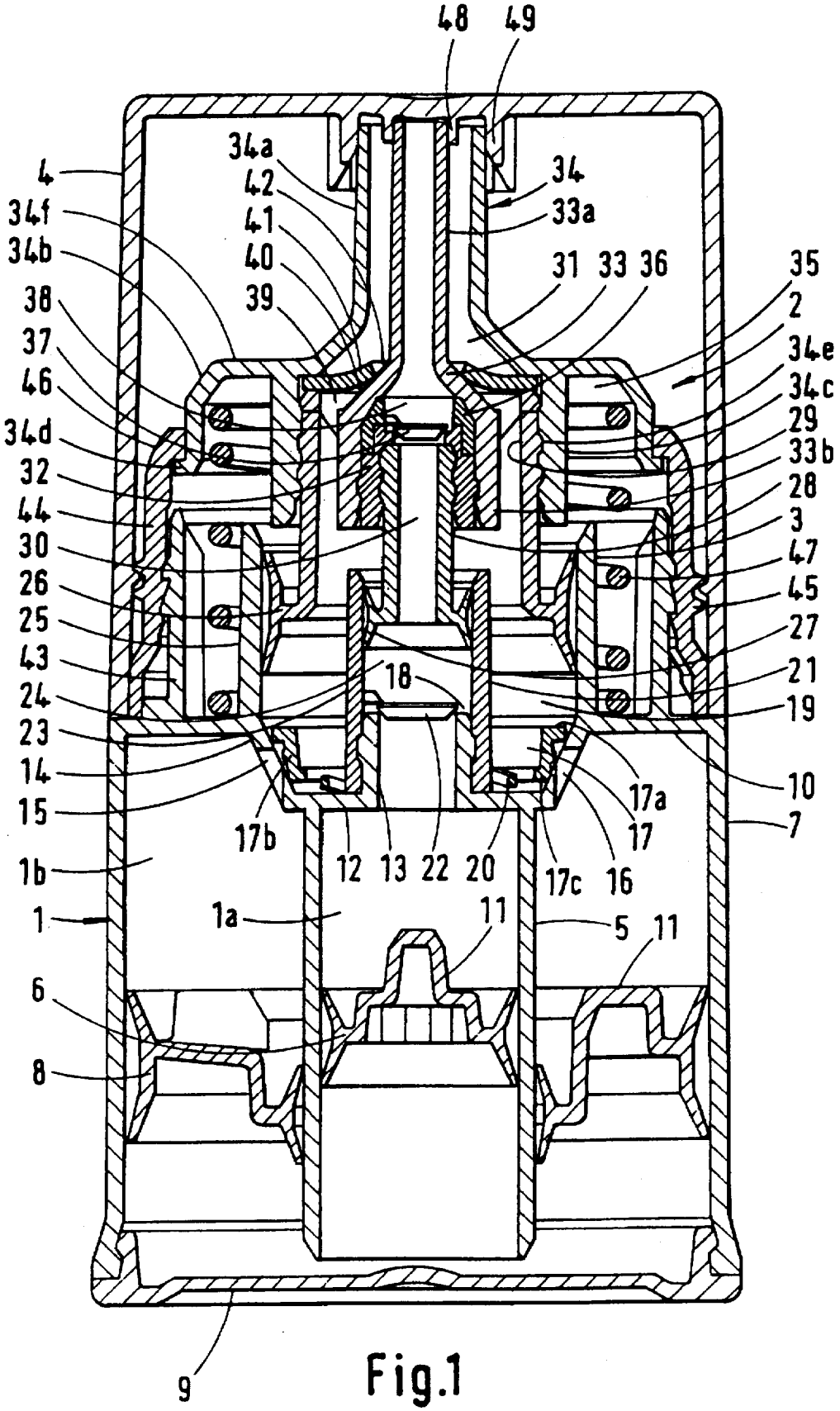
FIG. 1 shows a longitudinal sectional view of a dispenser of the invention.

It is preferred that the first and second pump chambers, and also the first and second material supply chambers are also coaxial.

The pumps are preferably manually operable, e.g. by single hand action to provide a compact portable dispenser.

In this description the term "coaxial" includes but is not limited to "concentric". It includes arrangements in which the perimeter of one element is arranged wholly within the perimeter of another.

In another preferred embodiment of the invention, an end portion of the first discharge channel is formed by an injector, and a second discharge channel which is entirely separated from the first discharge channel inside the head piece of the dispenser and used for discharging the second material is defined by a tubular body which surrounds said channel and simultaneously constitutes a pump actuating member of the dispenser.

By means of this last-described preferred embodiment the two materials, particularly two fluid phases of the type which form the compositions of EP 0152953, may be dispensed as a coaxial stream of the first and second materials, by displacement of the tubular body.

In a further preferred embodiment of the invention a dispenser for dispensing together a first fluid material and a second fluid material, having a first material supply chamber and a second material supply chamber comprises:

- a first pump chamber communicating with the first material supply chamber via a first non-return valve biassed to allow passage of first material only from the first material supply chamber to the first pump chamber;
- a second pump chamber communicating with the second material supply chamber via a second non-return valve biassed to allow passage of second material only from the second material supply chamber into the second pump chamber;
- the first pump chamber being coaxial with the second pump chamber;
- the dispenser also having an outlet portion comprising a first discharge channel for the first material and a second discharge channel for the second material;
- the first discharge channel comprising a discharge tube in a coaxial relationship within a surrounding tubular body, the second discharge channel being defined by the annular space between the discharge tube and the surrounding tubular body;
- the first pump chamber communicating with the first discharge channel via a third non-return valve biassed to allow passage of first material only from the first pump chamber into the first discharge channel, and the second pump chamber communicating with the second discharge channel via a fourth non-return valve biassed to allow passage of second material only from the second pump chamber into the second discharge channel;
- the first pump chamber and the second pump chamber having respectively first and second pump pistons slidably arranged therein;
- the surrounding tubular body or an extension thereof being connected in an actuating relationship with at least the second pump piston and
- optionally also with the first pump piston so that on axial movement of the surrounding tubular body both the first and second pistons are actuated.

For the constant supply of the first and second materials from the first and second material supply chambers with almost no delay, a follower piston which is preferably acted upon by atmospheric pressure may be slidably arranged in each of the material supply chambers.

The first and second material supply chambers are preferably located within a product container, and are also preferably in a coaxial relationship, for example in the form of a coaxial, preferably concentric, double tube arrangement having an inner first material supply chamber and a surrounding annular second material supply chamber. In such an arrangement the outer wall of whichever of the first or second material chambers is the outer may form or be integral with the outer wall of the product container. Moreover such an arrangement enables the chamber to be integrally formed and closed by a common end wall.

When the first and second material supply chambers are in a coaxial relationship as described above with a common end wall, the first and second non-return valves may be located in the end wall, or in a projection or extension thereof, and the respective first and second pump chambers may be located on the opposite side of the end wall to the material supply chambers and in communication therewith, via the respective first and second non-return valves.

When the first and second material supply chambers and pump chambers have this coaxial relationship, certain forms of first and second non-return valve are convenient. For example the first non-return valve, allowing passage into the inner first material supply chamber may conveniently be in the form of a flap valve which may be biassed opening into the first pump chamber. For example the second non-return valve allowing passage into the annular second pump chamber may be in the form of a biassed annular valve sleeve which in its closed position covers one or more holes in the end wall or in a projection or extension thereof which communicate between the second material supply chamber and the second pump chamber.

The coaxial first and second pump chambers are also preferably in an concentric, double tube, relationship having an inner first pump chamber and a surrounding annular second pump chamber. As a consequence of such a coaxial arrangement of the first and second pump chambers, the corresponding first and second pistons are also in a coaxial, preferably concentric relationship. Preferably for compactness the first and second pistons are both hollow pistons.

The first piston preferably communicates with the first discharge channel via an opening, preferably a central opening, in the first piston. This opening may communicate with a first piston carrier tube which in turn communicates with the first discharge channel, the said opening, carrier tube and discharge channel preferably all being coaxial. The first piston carrier tube may fit into the inner end of the first discharge channel, either directly or via an adaptor. Conveniently the third non-return valve may be situated in the opening in the first piston, or in the first piston carrier tube, or in the first discharge channel, or at the junction of the carrier tube and the discharge channel, or in the adaptor if present. Conveniently the third non-return valve may be a flap valve, which may be biassed, opening in a downstream direction.

The second piston preferably communuicates with the annular second discharge channel via a second piston carrier tube which surrounds at least part of the first discharge channel and/or the first piston carrier tube in a coaxial preferably concentric relationship, thereby defining an annular space around the first piston carrier tube, this annular space communicating with the annular second discharge channel, via the fourth non-return valve. This annular coaxial arrangment of the second piston carrier tube means that the fourth non-return valve is preferably in the form of an annular valve disc biassed to close one or more valve openings communicating between the said annular space and the annular second discharge channel.

The actuating relationship between the surrounding tubular body or an extension thereof and the second piston is preferably achieved by extending the tubular body into a cup-shaped actuation portion which at least partly encloses the second piston carrier tube. The walls of this actuation portion are arranged to bear either directly or indirectly upon the second piston carrier tube, so that axial displacement of the actuation portion under the action of axial actuating pressure applied to the actuation portion in a piston compressing direction during a pumping stroke causes a corresponding compressive displacement of the second piston carrier tube and hence of the second piston, causing pumping of the second material out of the second pump chamber through the fourth non-return valve and into the second discharge channel.

The walls of this actuation portion are also preferably arranged to bear directly or indirectly upon the first piston, so that axial displacement of the actuation portion causes a corresponding simultaneous compressive displacement of the first piston carrier tube and hence of the first piston, causing pumping of the first material out of the first pump chamber through the third non-return valve and into the first discharge channel.

During this pumping stroke the pressure in the first and second pump chambers forces the first and second non-return valves closed and prevents return of the materials to their respective chamber.

Indirect bearing of the walls of the actuation portion upon the first piston may be by the bearing of the actuator upon the first discharge channel or upon the adaptor if present or on the first piston carrier tube if present.

In a preferred embodiment of the invention, the first discharge channel is extended to form an injector, situated coaxially within an extended tubular body.

In such an arrangement pressure of the first or second discharge channels against a surface such as the skin can cause the actuation portion to bear upon the second piston carrier tube and thereby extrude both first and second material onto a precise point where they can mix. It is preferred that such an injector extends downstream of the tubular body for at least a small extent.

The cup-shaped actuation port;ion is preferably also resiliently biassed, for example by a spring, into a non-axially displaced position, and the second piston carrier tube and first piston carrier tube are also preferably so linked to the actuation portion that the action of the resilient bias can return both pistons into a non-axially displaced position when the actuating pressure is removed. Methods of arranging such a spring will be apparent to those skilled in the art, but a preferred arrangement is of a helical spring, coaxial, preferably concentric with and surrounding the second pump chamber, and mounted so as to bear against the end wall and the cup-shaped actuation portion.

During a return stroke in which the first and second pistons return into an uncompressed inoperative position, the first and second materials are thus pushed or sucked from the first and second material supply chambers into the first and second pump chamber, with the first and second non-return valves being opened, and are available in the first and second pump chambers for another dispensing operation.

An almost instantaneous dispensation of the first and second materials at a low delivery pressure and along small pump paths may be accomplished by the measures described above that a first non-return valve is arranged between the first material supply chamber and the first pump chamber which is connectable to the first material supply chamber, that a second non-return valve is arranged between the second material supply chamber and the second pump chamber which is connectable to the second material supply chamber, and that each of the discharge channels is controllable downstream of the first and second non-return valves by a third non-return valve and a fourth non-return valve respectively, and the valve bodies of the non-return valves are each controllable in response to a pressure difference upstream and downstream of the respective non-return valve. Moreover the provision of two separate sets of valves, i.e. first/second and third/fourth is found to substantially reduce or even eliminate suck-back of materials and to overcome the problems of variation in material viscosity and pumping pressure at least to some extent, making the rate of dispensing relatively independent of these variables.

A particularly useful feature of the dispenser of the invention is the ability to precisely control the ratio of the first and second materials dispersed over a wide range of total volume dispersed.

The dispenser may also be provided with a cap means, arranged to fit onto the product container, and also arranged to specifically and individually seal the first discharge channel and the tubular body. To facilitate this the product container may be cylindrical, and the cap may conventionally snap-fit or push-fit over the dispensing end of the container.

The first and second materials may be liquids, gels, pastes, solutions, suspensions, emulsions etc. The piston pumps described above are self-priming and in use there appears to be no need to fill the first and second pump chambers with their respective materials prior to operation of the pumps.

As mentioned above advantageous features of the dispensing device of this invention are particularly suited to dispensing a pharmaceutical composition of the type described in EP 0151953A, i.e. being a pharmaceutical composition for topical application, comprising a first liquid phase containing a drug dissolved therein, and a second liquid phase, physically and and/or chemically different from the first phase but miscible therewith, optionally containing the same drug dissolved therein, the concentration of drug in each phase and the composition of the phases being such that, on admixture of the phases, the resultant total drug concentration is greater than the saturated drug solubility in the initially formed resultant mixture, thereby producing a mixture supersaturated with the drug.

Such compositions are more fully described in EP 01151953A, the contents of which are incorporated herein by reference. The first and second liquid phases of such composition may be used as either the first or second materials of the dispenser of this invention. Suitably the first liquid phase of such a composition may comprise the first material, and the second liquid phase of such a composition may comprise the second material of this invention. This invention therefore further provides a dispenser as described above when containing such a composition, with the first and second liquid phases comprising the two materials of the device of this invention.

The preferred use for such compositions also defines preferred volume ratios for the first and second material chambers and pump chambers, i.e. from 1:1 to 1:9 more suitably from 1:1 to 1:3.

The invention will now be described by way of example with reference to the accompanying drawings FIGS. 1 and 2 which show two forms of the device of the invention in a longitudinal sectional view.

Referring to FIG. 1, the dispenser consists of a cylindrical container 1, generally, for separately receiving the first material in a first material supply chamber 1*a* and for receiving the second material in a second material supply chamber 1*b* that annularly surrounds the first material supply chamber 1*a*, and it further consists of a head piece 2, generally, which includes the delivery means 3, generally, for dispensing the first and second materials.

In the inoperative state the dispenser is closed by a closure cap 4 which can be put over head piece 2 onto container 1 in a snap-type seat.

The individual members of the dispenser are made of an injection-mouldable plastic, preferably polyethylene or polypropylene, so that on the one hand the dispenser is of a light weight construction, and on the other hand the materials filled into container 1 are unaffected by the material of the dispenser.

Container 1 of the dispenser integrally includes a coaxial double-tube assembly with a central tube 5 for forming the first material supply chamber 1*a* and for receiving the first material and a first follower piston 6 therein said central tube 5 is radially spaced from and surrounded by an outer tube 7 which defines the outer container wall and serves to form the second material supply chamber 1*b* and to receive the second material as well as an annular second follower piston 8. Follower pistons 6, 8 which are coaxially arranged and slidable in the axial direction of the container are acted upon by atmospheric pressure,as bottom plate 9 of container 1 does not provide a pressure-tight seal for the chamber below follower pistons 6, 8. Central tube 5 and outer tube 7 (outer container wall) of container 1 are integrally connected to each other by an end wall 10 which simultaneously separates head piece 2 of the dispenser with delivery means 3 from product container 1 containing the first and second materials.

The first and second follower pistons 6, 8 are equipped with ring or stop projections 11 which correspond to the shape of the upper portion of the first and second material supply chambers 1*a*, 1*b* near end wall 10, so as to allow said chambers to be entirely emptied and act as a stop for follower pistons 6, 8. The first and second materials in the first and second material supply chamber 1*a*, 1*b* are constantly subjected to atmospheric pressure on account of the slidable follower pistons, 6, 8, so that during use of the dispenser container 1 is emptied from bottom to top under the pressure of follower pistons 6, 8. The upward supply of the first and second materials within container 1 towards delivery means 3 arranged in head piece 2 is hereby ensured in a very simple way, and the generation of vacuum within container 1 as well as the entry of air to the first and second material supply chambers 1*a*, 1*b* are avoided when the first and second materials are discharged from the dispenser.

End wall 10 of container 1 comprises a lowered central portion 12 and is provided with a centrally upwardly protruding tubular projection 13 in which the first material supply chamber 1*a* terminates. The central portion 12 of end wall 10 is connected to a peripheral annular portion of end wall 10 by a frustro-conical connection portion 14 which includes a plurality of valve openings 15 of a second non-return valve 16 which are preferably evenly distributed in a circumferential direction and through which the second material supply chamber 1*b* can establish flow communication with a second pump chamber 19 formed in head piece 2. Valve openings 15 of the second non-return valve 16 are controllable by an annular valve body 17 which is provided with an upper flanged projection 17*a* and has an inclined outer contour with a flow control bead 17*b*, as well as a lower edge 17*c* that seals valve openings 15 together with the flanged projection 17*a* in an inoperative position of the annular valve body, as is shown in FIG. 1. The annular valve body 17 is urged into its lower closing-position by a valve spring 20 which is preferably integral with said valve body 17 and made of plastics and axially fixed in the area of end wall 10. Annular valve body 17 is here biased such that it is movable axially upwards against the biasing force of valve spring 20 towards the opening of the second non-return valve 16 when the second material is supplied from the second material supply chamber 1*b* by the second follower piston 8 and at a reduced pressure downstream of annular valve body 12 into the second pump chamber 19.

Tubular projection 13 of end wall 10 has provided thereon a first valve sleeve 21 with a valve flap 22 hinged thereto at one side as the valve body of a first non-return valve 23. Valve flap 22 cooperates with an outlet opening 18 of tubular projection 13 in such a way that in a closing position as is shown in FIG. 1, it sealingly closes outlet opening 18 of tubular projection 13. The first valve sleeve 21 is coaxially accommodated on tubular projection 13 via a snap-type connection, which is of advantage to an easy assembly, and extends through the second pump chamber 19 and annular valve body 17.

Valve flap 22 controls the flow communication between the first material supply chamber 1*a* with the first material upstream below valve flap 22 and a first pump chamber 24 downstream, i.e. above valve flap 22.

End wall integrally comprises a first axial cylindrical projection 25 coaxially to and radially spaced externally from tubular projection 13 and the first valve sleeve 21, respectively. Cylindrical projection, 25 defines the second pump chamber 19 in which valve opening 15 of the second non-return valve 16 terminates, and a second pump piston 26 is slidably supported on the inner wall of said projection 25.

The second pump piston 26 is coaxial, to a first pump piston 27 which is slidable in the first valve sleeve 21 and defines the first pump chamber 24.

Both the first and second pump pistons 27, 26 are formed as hollow pistons, and each of them integrally comprises first and second piston carrier tubes 28 and 29, respectively, forming a portion of a first discharge channel 30 and a second discharge channel 31, respectively, for the first and second materials.

The structure of the head piece 2 with delivery means 3 shall now be explained in a general way with reference to the already described elements of the delivery means 3.

An upper actuation end of first piston carrier tube 28 of the first pump piston 27 is accommodated via an adapter sleeve 32 in an injector 33 which, in turn, is accommodated in a tubular actuation body 34, generally, forming the second discharge channel 31 and is axially slidable together with said body 34.

Tubular actuation body 34 comprises a tubular end portion 34*a* which coaxially surrounds a discharge tube 33*a* of injector 33 whereby an annular channel is formed as part of the second discharge channel 31. Discharge tube 33*a*, in turn, forms an end portion of the first discharge channel 30. Further tubular actuation body 34 comprises a cup-shaped actuation portion 34*b* with an integral inner cylindrical portion 34*c* and an outer circumferential snap-type projection 34*d*, which is stiffened by transverse ribs 35 relative to the inner cylindrical portion 34*c*.

The inner periphery of the inner cylindrical portion 34*c* includes moulded snap-type elements 34*e* which are in locking engagement with complementary elements on the outer circumferential surface of the second piston carrier tube 29 of the second pump piston 26. As a result, the inner cylindrical portion 34*c* is active as a motion-transmitting support element of the second pump piston 26 and of piston carrier tube 29 which is integral therewith. An axial movement of tubular actuation body 34 is thereby transmitted in an identical way to the second pump piston 26.

As becomes apparent from FIG. 1, the injector 33 comprises a lower tubular end portion 33*b* which is radially enlarged relative to discharge tube 33*a* and supports the upper end of piston carrier tube 28 of the first pump piston 27 in the interior via adapter sleeve 32 and associated moulded snap-type elements and accommodates a second valve sleeve 36 with an integral valve flap 37 above piston carrier tube 28 and upstream thereof. The valve flap 37 cooperates with an annular opening of valve sleeve 36 to form a third non-return valve 38 and to control the discharge of the first material through the first discharge channel 30.

Furthermore, injector 33 comprises an annular engagement flange 39 which in the area of the transition from discharge tube 33*a* to tubular end portion 33*b* extends radially outwards and is stiffened by ribs. Annular engagement flange 39 comprises a plurality of valve openings 40, which are preferably evenly distributed in a circumferential direction, as well as a valve seat surface adjacent thereto. An elastic valve disk 41 is interposed in a circumferential edge portion between annular carrier flange 39 and cup-shaped actuation portion 34*b* of tubular actuation body 34. Valve disk 41 has an annular configuration and rests with its inner circumference—for the control of valve openings 40—on a transition portion between discharge tube 33*a* and tubular end portion 33*b* of injector 33, being biased by its own elasticity inherent to its material, and forms a fourth non-return valve 42 for controlling the second discharge channel 31. An axial movement of tubular actuation body 34 is thus transmitted via annular engagement flange 39 of injector 33 to the latter and to the first pump piston 27 supported by injector 33 so as to obtain a synchronous movement with the second pump piston 26.

A cylindrical body 43 is integrally or separately connected to end wall 10 of container 1 radially externally with respect to the axial cylindrical projection 25 of end wall 10. Cylindrical body 43 serves to lockingly receive an outer snap-type sleeve 44 which, in turn., circumferentially includes snap-type projections 45 for a snap-type seat of closure cap 4 as well as an engagement projection 46 at its upper end for locking engagement with the cicumferential snap-type projection 34*d* of tubular actuation body 34. Tubular actuation body 34 is thereby reliably retained, and foreign matter is simultaneously prevented by snap-type sleeve 44 from penetrating into head piece 2. In a space provided between cylindrical body 43 and inner cylindrical projection 25, a helical compression spring 47 extends in axially biased fashion between end wall 10 and transverse ribs 35 of tubular actuation body 34. After a dispensing operation helical compression spring 47 ensures the return of tubular actuation body 34 together with the associated pump pistons 27, 26 into the inoperative position shown in FIG. 1.

In its inner bottom portion closure cap 4 centrally comprises coaxial ring projections 48, 49 for sealingly engaging the respectively upper end of annular actuation body 34 and injector 33 and for closing the first and second discharge channels 30 and 31. This prevents the drying out of any first and second materials remaining in the tubular end portion 34*a* of tubular actuation body 34 or in the end portion 33*b* of injector 33.

All of the above-described individual members of the dispenser, possibly with the exception of helical spring 47 which may be made of metal, consist of plastics and are manufactured as injection-moulded parts preferably consisting of polyethylene or polypropylene.

The operation of the dispenser shall now be described. It is assumed that follower pistons 6, 8 are in their lower end position, that the first and second material supply chamber 1*a*, 1*b* are filled with the first material and the second material respectively, which materials are to be dispensed accurately at a common point of application but without being mixed, and that the first and second material are also positioned in the first and second pump chambers 24, 19 and in the first and second discharge channels 30, 31 adjacent thereto. If, outside the first and second material supply chambers 1*a*, 1*b*, there is at first no material in pump chambers 24, 19, the first and second materials must first be fed, after removal of closure cap 4, from the first and second material supply chambers 1*a* and 1*b* into the first and second pump chambers 24 and 19 by axially depressing tubular actuation body 34 against the resilient force of helical compression spring 47, with the first and second pump pistons 27 and 26 being simultaneously carried along in a preparatory stroke.

If the first and second materials are present in the first and second pump chambers 24 and 19, respectively, the depression of the tubular actuation body 34 together with the downward movement of the first and second pump pistons 27, 26 has the effect that the pressure in the first and second pump chambers 24, 19 increases, so that valve flap 22 assumes the closing position shown in the figure with respect to tubular projection 13, and annular valve body 17 is also retained in the illustrated closing position over the valve openings 15. The reduced volumes of the first and second pump chambers 24, 19 and the simultaneous increase in pressure have the effect that the first material is fed upwards from the first pump chamber 24 through the piston carrier tube 28 of the first pump piston 27, and valve flap 37 of the second valve sleeve 36 is pivoted in its open position, so that the first material passes through injector 33 and its end portion 33*b* to the upper discharge opening of injector 33. Corresponding material flow and pressure conditions exist with regard to the second material in the second pump chamber 19 in connection with the downward sliding movement of the second pump piston 26, so that the second material is simultaneously passed upwards through the inner annular chamber between the second piston carrier tube 29 of the second pump piston 19 and the end portion 33*b* of injector 33 and is dispensed through the annular end portion 34*a* of the tubular actuation body 34 and injector 33 at the opening of the second discharge channel 31 under release of the valve openings 40 by the elastic valve disk 41, which is elastically deformed in its open position. During the sliding operation the tubular actuation body 34 is slidingly guided by both snap-type sleeve 44 and pump pistons 26, 27 together with the associated slide surfaces of the axial cylindrical projection 25 and the first valve sleeve 21, respectively. The available stroke is here determined by the distance between a lower edge of the circumferential snap-type projection 34*d* and the upper end of cylindrical body 43.

The tubular actuation body 34 may be depressed by hand pressure, for example by holding the container 1 in the hand and pressing the open end of the tubular end portion 34*a* against a surface. Alternatively the container 1 may be gripped by the hand, and finger or thumb pressure applied to the upper surface 34*f* of the end portion. The surface 34*f* may be provided with finger pads to assist this.

When the tubular actuation body 34 subsequently no longer depressed, it slides together with injector 33 and the first and second pump pistons 27, 26 under the action of helical spring 47 upwards back in its initial position as is shown in FIG. 1. Pump chambers 24 and 19 become now larger again. The resultant vacuum has the effect at the annular valve body 17 is removed from its valve seat on connection portion 14 and moves upwards against the resilient force of valve spring 20, so that valve openings 15 are released and the second material is fed the second pump chamber 19 with annular follower piston 8 moving upwards. The same is applicable with regard to the opening of valve flap 22 which pivots upwards and permits the supply of the first material with the aid of follower piston 6 into the first pump chamber 24. The third and fourth non-return valves 38, 42 are here closed or perform their closing operation at the beginning of the return movement due to the decreased pressure in the first and second pumps chambers 24, 19. This closing movement of the second valve flap 37 and of valve disk 41 is supported by a certain back suction of with material plug positioned above valve disk 41 and valve flap 37 and formed by the first and second materials.

A very accurate supply of liquid, paste-like or viscous materials, which are e.g. applied to human or animal bodies, is thus possible without the material components being premixed inside the dispenser. A neat separation of the first and second materials is also accomplished in the area of the outlets of the first and second discharge channels 30 and 31 through the slightly greater axial extension of injector 33. As a result of this configuration, the discharge openings are not positioned in a horizontal plane.

Of course, many modifications and alterations of the structural design of the dispenser are possible with regard to end wall 10 and delivery means 3 in head piece 2 of the dispenser.

For instance, the separate adapter sleeve 32 could optionally be dispensed with, just like the second valve sleeve 36, if piston carrier tube 28 was received in direct snap connection on injector 33 or if valve flap 37 of the second valve sleeve 36 was e.g. integrally formed with piston carrier tube 28 or injector 33. As far as the first cylindrical projection 25, cylindrical body 43 and snap-type sleeve 44 are concerned, the invention is not limited to the illustrated embodiment. Cylindrical body 43 could optionally be used a means for receiving the closure cap and also for forming engagement projection 46 for locking tubular actuation body 34 and as a slide guide for said body 34.

A compact design of the dispenser is achieved through the coaxial configuration of the material flow paths of the first and second materials according to the invention, with the individual parts being mountable in an advantageous way and manufacturable as injection-moulded parts of plastics.

Figure 2:
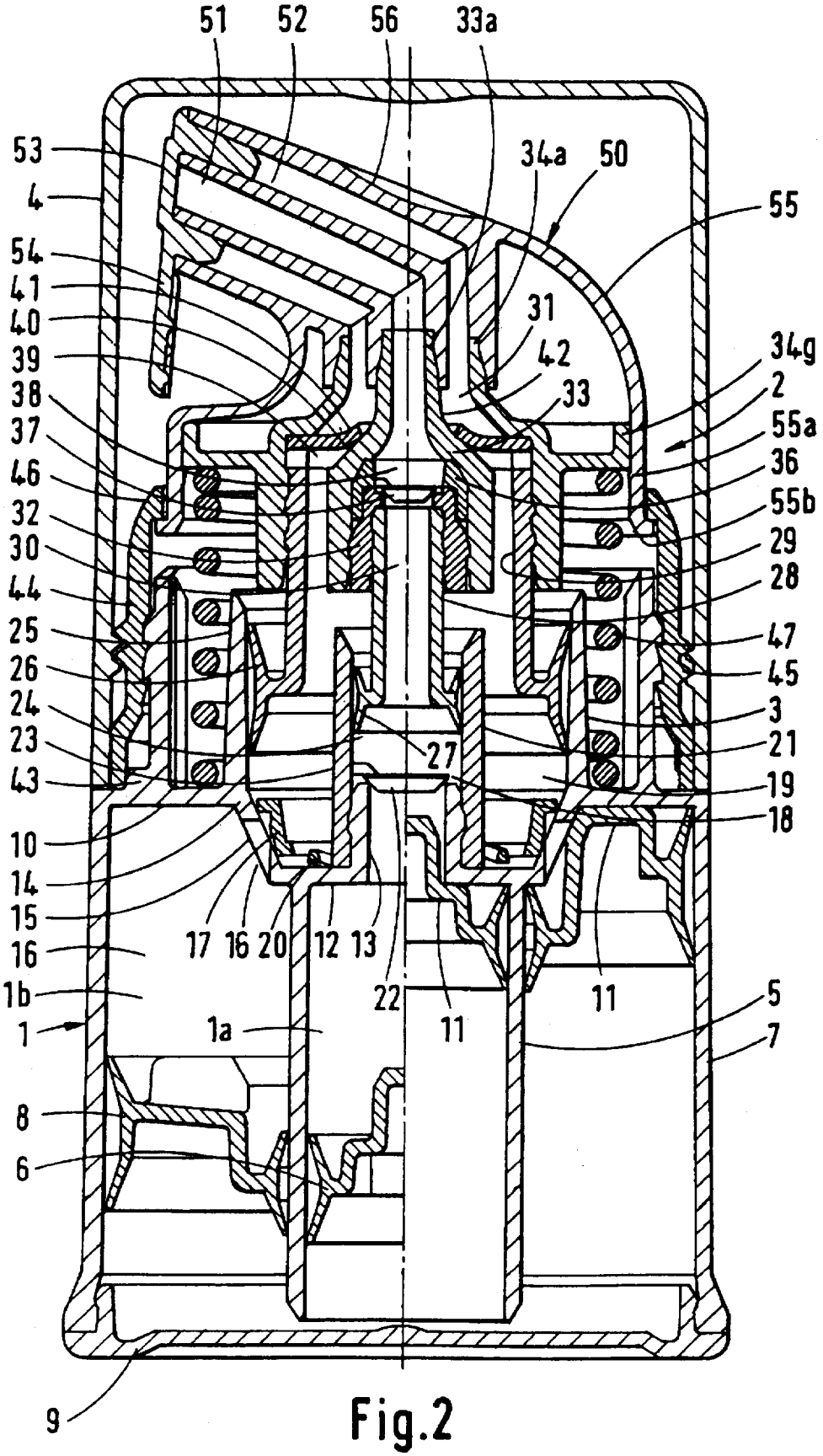
FIG. 2 shows a longitudinal sectional view of a preferred embodiment of the dispenser, showing an angled delivery means.

Referring to FIG. 2, second form of the device of the invention is shown. In this form of the device it will be apparent that the overall construction and operation of the container 1, the lead piece 2, and the closure cap 4 are the same as shown in FIG. 1, and corresponding parts are numbered correspondingly.

The left half of FIG. 2 shows the first follower piston 6 and the second follower piston 8 in an intermediate position near the initial position (bottom) and the right half of FIG. 2 shows the first follower piston 6 and the second follower piston 8 in their upper end positions against respectively projection 13 and end wall 10. The ring or stop projections 11 are up against the correspondingly shaped upper portions of projection 13 and end wall 10, so as to leave the minimum practicable void space in the upper end of chambers 1*a* and 1*b* respectively.

The delivery means 3 of the device of FIG. 2 differs from that of FIG. 1 in that the delivery means is constructed so that the materials contained in chambers 1*a* and 1*b* are delivered in a direction at an angle to the overall axis of the container 1, head piece 2 and closure cap 4.

In the embodiment of FIG. 2 this angled delivery is achieved by the provision of a delivery head 50, generally, which incorporates coaxial inner dispensing channel 51 and outer dispensing channel 52. The inner and outer dispensing channels, 51, 52 cooperate respectively in a fluid-tight engagement with a shortened discharge tube 33*a* and tubular end portion 34*a*.

The inner and outer dispensing channels 51, 52 bend through an angle relative to the longitudinal axis of the container 1 and head piece 2 to define a delivery direction at an angle to the axis of the discharge tube 33*a* and portion 34*a* whilst remaining coaxial. The dispensing channels 51, 52 terminate at respective open ends, which are closed by a removeable closure 53 provided with a handle 54 for easy opening.

The dispensing channels 51, 52 are formed integrally with a bell-shaped cover 55, which is shaped so as to fix over a projecting part 34*g* of the actuation body. The cover 55 is provided with inwardly projecting elements 55*a* which engage with the lower edge of the projecting part 34*g*. The cover 55 is also provided with outer circumferential snap-type projection 55*b* to enable it to be retained within the outer snap-type sleeve 44.

The bell-shaped cover and the delivery tubes 51, 52 are enclosed by the closure cap 4.

The device of FIG. 2 operates in a manner analogous to that of FIG. 1. The outer surface of the bell-shaped cover 54 is provided with a recess 56 to facilitate insertion of the thumb and thereby hand operation of the device by gripping the container 1 in the hand and applying thumb pressure to the recess 56, so that pressure is communciated to the actuation body 34.

We claim:

1. A dispenser for dispensing together a first fluid material and a second fluid material, comprising a first material supply chamber and a second material supply chamber for respectively containing said first and second fluid materials, a head piece which comprises a first pump chamber having a first pump piston slidably arranged therein, and being connected to a first discharge channel which comprises an outlet portion for the first fluid material, and to the first material supply chamber, and a second pump chamber having a second pump piston slidably arranged therein, and being connected to a second discharge channel which comprises an outlet portion for the second fluid material and to the second material supply chamber, the said pump pistons being operable by hand action, an end portion of said first discharge channel being formed by a discharge tube, and the second discharge channel is defined by a tubular body which surrounds said first discharge channel, the discharge tube being in a coaxial relationship within the surrounding tubular body, the second discharge channel being defined by an annular space between the discharge tube and the surrounding tubular body such that the second discharge channel is separated from the first discharge channel by the discharge tube so there is no premixing of the first and second fluid materials within the dispenser, wherein the first pump chamber communicates with the first material supply chamber via a first non-return valve biased to allow passage of the first material only from the first material supply chamber to the first pump chamber, wherein the second pump chamber communicates with the second material supply chamber via a second non-return valve biased to allow passage of the second material only from the second material supply chamber into the second pump chamber, wherein the first pump chamber communicates with the first discharge channel via a third non-return valve biased to allow passage of the first material only from the first pump chamber into the first discharge channel, and wherein the second pump chamber communicates with the second discharge channel via a fourth non-return valve biased to allow passage of the second material only from the second pump chamber into the second discharge channel.

2. A dispenser according to claim 1 wherein the first and second pump chambers are in a coaxial arrangement.

3. A dispenser according to claim 1 wherein the first and second material supply chambers are in a coaxial arrangement.

4. A dispenser according to claim 1 wherein the surrounding tubular body is connected in an actuating relationship with at least the second pump piston.

5. A dispenser according to claim 4 wherein the actuating relationship between the surrounding tubular body and the second pump piston is achieved by the tubular body being extended into a cup-shaped actuating portion which at least partly encloses the second discharge channel, and the cup-shaped actuating portion is arranged to bear upon a second piston carrier tube integral with the second pump piston.

6. A dispenser according to claim 1 wherein the surrounding tubular body is connected in an actuating relationship with the first pump piston so that on axial movement of the surrounding tubular body the first piston is actuated.

7. A dispenser according to claim 1 wherein the volume ratios of the first material supply chamber:second material supply chamber or first pump chamber:second pump chamber is in the range 1:1 to 1:9.

* * * * *